US006113437A

United States Patent [19]

Abe

[11] Patent Number: 6,113,437

[45] Date of Patent: Sep. 5, 2000

[54] COMBINATION CONNECTOR

[75] Inventor: Kimihiro Abe, Shizuoka, Japan

[73] Assignee: Yazaki Corporation, Tokyo, Japan

[21] Appl. No.: 09/088,729

[22] Filed: Jun. 2, 1998

[30] Foreign Application Priority Data

Jun. 6, 1997 [JP] Japan ..... 9-149556

[51] Int. Cl.[7] ..... H01R 13/514

[52] U.S. Cl. ..... 439/701

[58] Field of Search ..... 439/701, 659, 439/717, 718

[56] References Cited

FOREIGN PATENT DOCUMENTS 2-223171 9/1990 Japan ..... H01R 13/514

*Primary Examiner*—Steven L. Stephan
*Assistant Examiner*—Eugene G. Byrd
*Attorney, Agent, or Firm*—Sughrue, Mion, Zinn, Macpeak & Seas, PLLC

[57] ABSTRACT

A combination connector is disclosed. The combination connector comprising a plurality of connector housings which are stacked together in a multi-stage manner, an elastic lock arm provided on one of a upper connector housing and a lower housing of any two adjacent connector housings in the plurality of connector housings, an elastic rib formed respectively in continuous relation to the lock arm, and an engaging portion provided on the other connector housing of the two adjacent connector for engaging with the lock arm, wherein the lock arm is flexed together with the associated rib when the lock arm is to be engaged with the engaging portion.

9 Claims, 5 Drawing Sheets

COMBINATION CONNECTOR

BACKGROUND OF THE INVENTION

1. Field of the Invention

The present invention relates to a combination connector constituted by a plurality of connector housings stacked together in a multi-stage manner.

2. Background of the Related Art

FIGS. 5 and 6 show an combination connector 1 disclosed in Unexamined Japanese Patent Publication No. Hei 2-223171. This combination connector 1 comprises three connector housings 2, 3 and 4 and a cover 5 for closing the uppermost connector housing 2. Elastic engaging frame portions 6, each defining a engaging hole 7, project from a lower portion of each of opposite side surfaces of each of the connector housings 2 and 3, and engaging projections 8 are formed on an upper portion of each of the opposite side surfaces. Only engaging projections 8 are formed on the lowermost connector housing 4. Elastic retaining frame portions 6, each defining a engaging hole 7, are formed also on the cover 5 which closes the uppermost connector housing 2.

As shown in FIG. 6, the connector housings 2, 3 and 4 are stacked together in a multi-stage manner, and the engaging projections 8 on the lower one of the adjacent connector housings are fitted and engaged in the engaging holes 7 provided at the upper connector housing, thereby combining the three connector housings 2, 3 and 4 together.

In the above combination connector 1, however, when the connector housings 2, 3 and 4 are to be combined together, each retaining frame portion 6 is much flexed or elastically deformed when it slides over the engaging projection 8, and therefore the retaining frame portions 6 have a permanent set in fatigue because of this excessive flexing. As a result, there is a possibility that the connector housings 2, 3 and 4 are accidentally disconnected from each other. And besides, when the retaining frame portions 6 have a permanent set in fatigue, there is encountered a problem that the connector housings 2, 3 and 4 can shake relative to each other, and therefore can not be firmly combined together.

SUMMARY OF THE INVENTION

It is therefore an object of the present invention to provide a combination connector in which a plurality of connector housings can be firmly combined together.

In order to achieve the above object, according to the first aspect of the present invention, there is provided a combination connector comprising a plurality of connector housings which are stacked together in a multi-stage manner, an elastic lock arm provided on one of a upper connector housing and a lower housing of any two adjacent connector housings in the plurality of connector housings, an elastic rib formed respectively in continuous relation to the lock arm, and an engaging portion provided on the other connector housing of the two adjacent connector for engaging with the lock arm, wherein the lock arm is flexed together with the associated rib when the lock arm is to be engaged with the engaging portion.

In this manner, when the lock arms are to be engaged respectively with the retaining portions, each of the lock arms is flexed together with the associated rib, and therefore the flexing stress, acting on the lock arm, is small, thereby preventing a permanent set of the lock arm. As a result, the lock arm can be firmly retained relative to the retaining portion, and the plurality of connector housings can be firmly combined together.

According to the second aspect of the present invention, there is provided a combination connector in which the lowermost connector housing in the plurality of connector housings further includes a cover for covering a lower side of the lowermost connector housing, an elastic lock arm provided on one of the cover and side wall of the lowermost connector housing, an elastic rib formed in continuous relation to the elastic lock arm, and an engaging portion provided on the other of the cover and the side wall of the lowermost connector housing for engaging with the lock arm, wherein the lock arm is flexed together with the associated rib when the lock arm is to be engaged with the engaging portion.

In this manner, when the lower side of the lowermost connector housing is to be covered with the cover, the lock arms are brought into engagement with the engaging portions, respectively, so that each lock arm is flexed together with the associated rib, and therefore the flexing stress on the lock arm is reduced, and a permanent set of the lock arm is prevented.

According to the third aspect of the present invention, there is provided a combination connector in which a engaging hole is formed in the lock arm provided on the one of the upper connector housing and the lower connector housing in the two adjacent connector housings, and the engaging portion provided on the other of the two connector housings is in the form of a projection which is fitted and engaged in the associated engaging hole.

In this manner, when the projection is to be fitted and engaged in the engaging hole in the lock arm, the lock arm is flexed together with the rib, and therefore the flexing stress on the lock arm is reduced, and a permanent set of the lock arm is prevented.

According to the fourth aspect of the present invention, there is provided a combination connector in which the lock arm and the rib provided on the one of the upper connector housing and the lower connector housing in the two adjacent connector housings is respectively a pair of lock arm members and a pair of rib members, and the engaging portion provided on the other of the two adjacent connector housings is a pair of engaging portions, and wherein the pair of lock arm members and ribs are formed respectively on opposite side walls of the one of the two adjacent connector housings, and the pair of engaging portions are formed respectively on the opposite side walls of the other connector housing of the two adjacent connector housings.

In this manner, the lock arms are engaged respectively with the engaging portions at the opposite side portions of the connector housing, and therefore the connector housings of the combination connector can be firmly combined together.

BRIEF DESCRIPTION OF THE DRAWINGS

In the accompanying drawings:

FIG. 4(*b*) is a cross-sectional view taken along the line b—b of FIG. 4(*a*);

DETAILED DESCRIPTION OF THE PREFERRED EMBODIMENT

Figure 1:
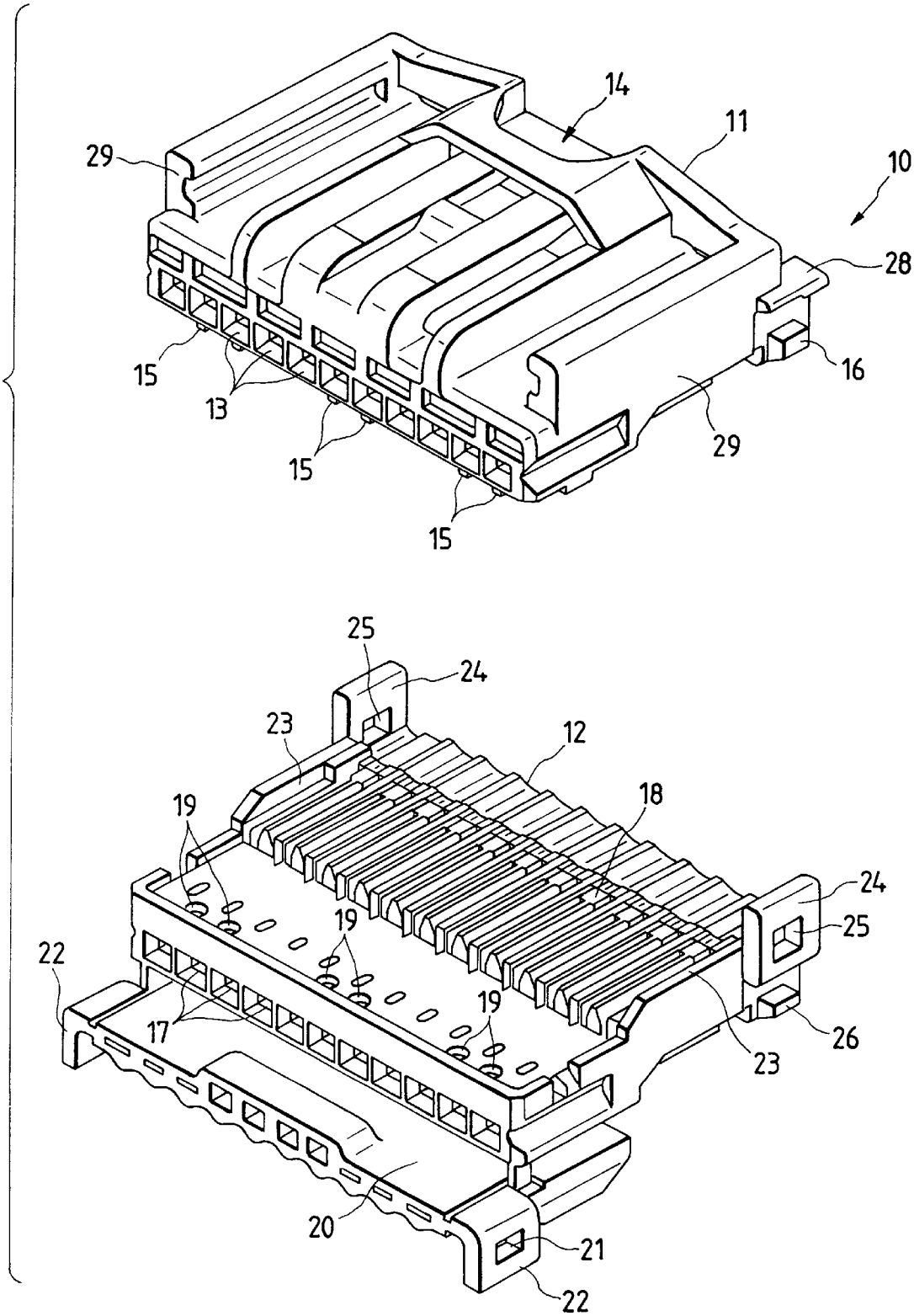
FIG. 1 is a perspective view showing an upper connector housing and a lower connector housing which jointly constitute a combination connector of the present invention.
Figure 2:
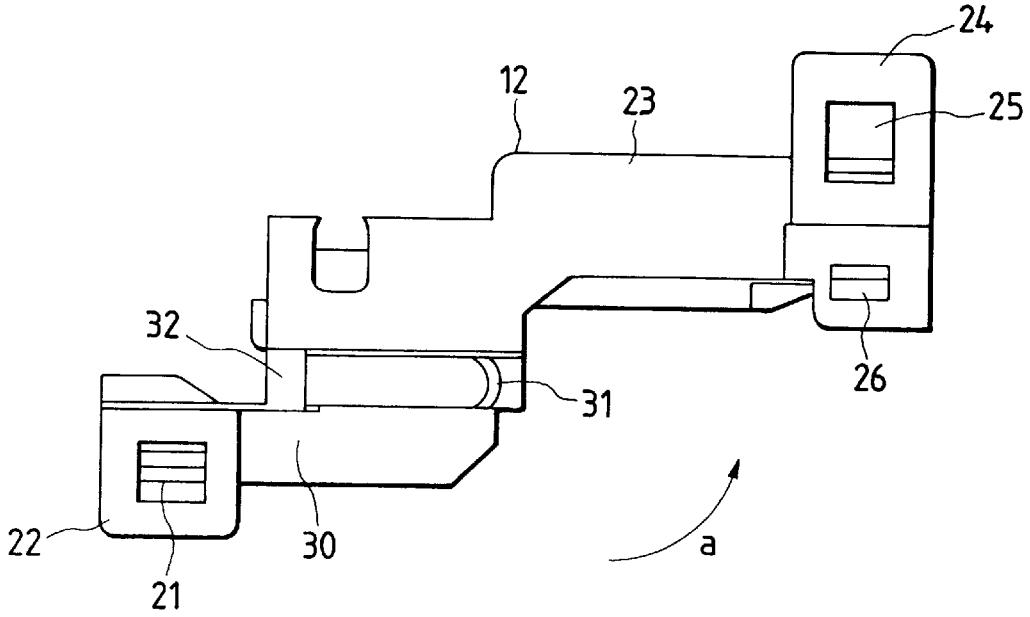
FIG. 2 is a side view showing the lower connector housing.
Figure 3:
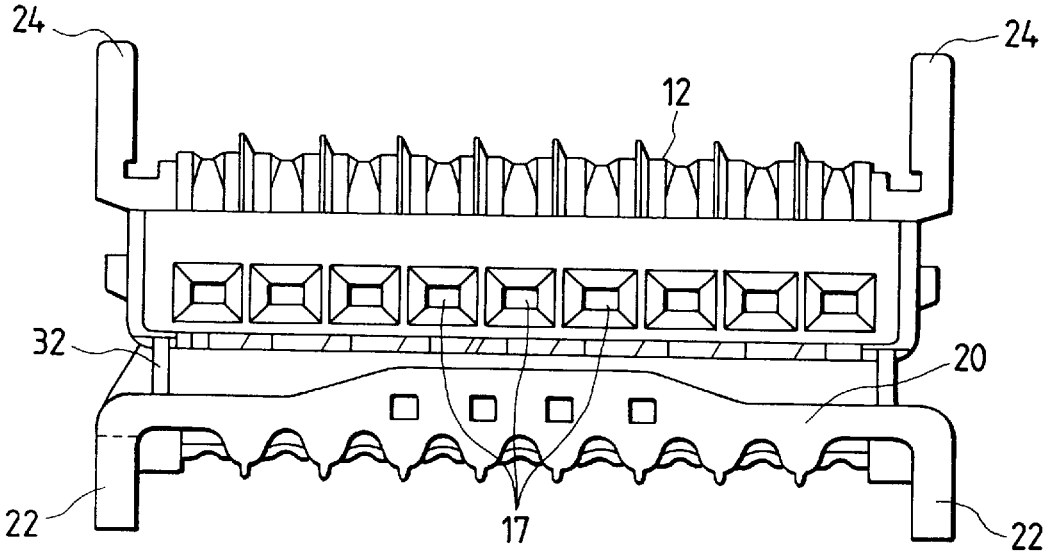
FIG. 3 is a front view showing the lower connector housing.
Figure 4A:
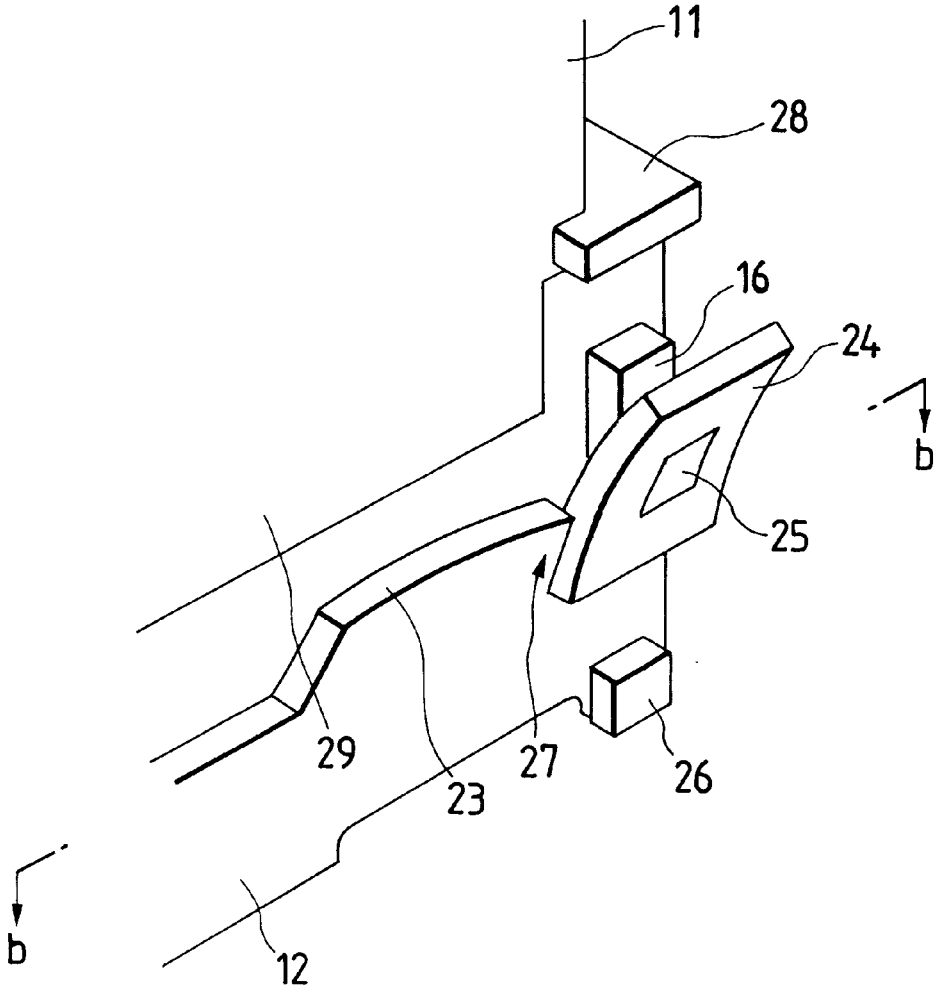
FIG. 4(*a*) is a perspective view showing the relation between a lock arm and a rib of the lower connector housing and a engaging projection of the upper connector housing.
Figure 4B:
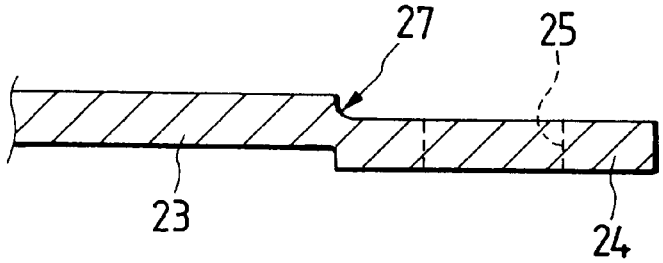
Figure 5:
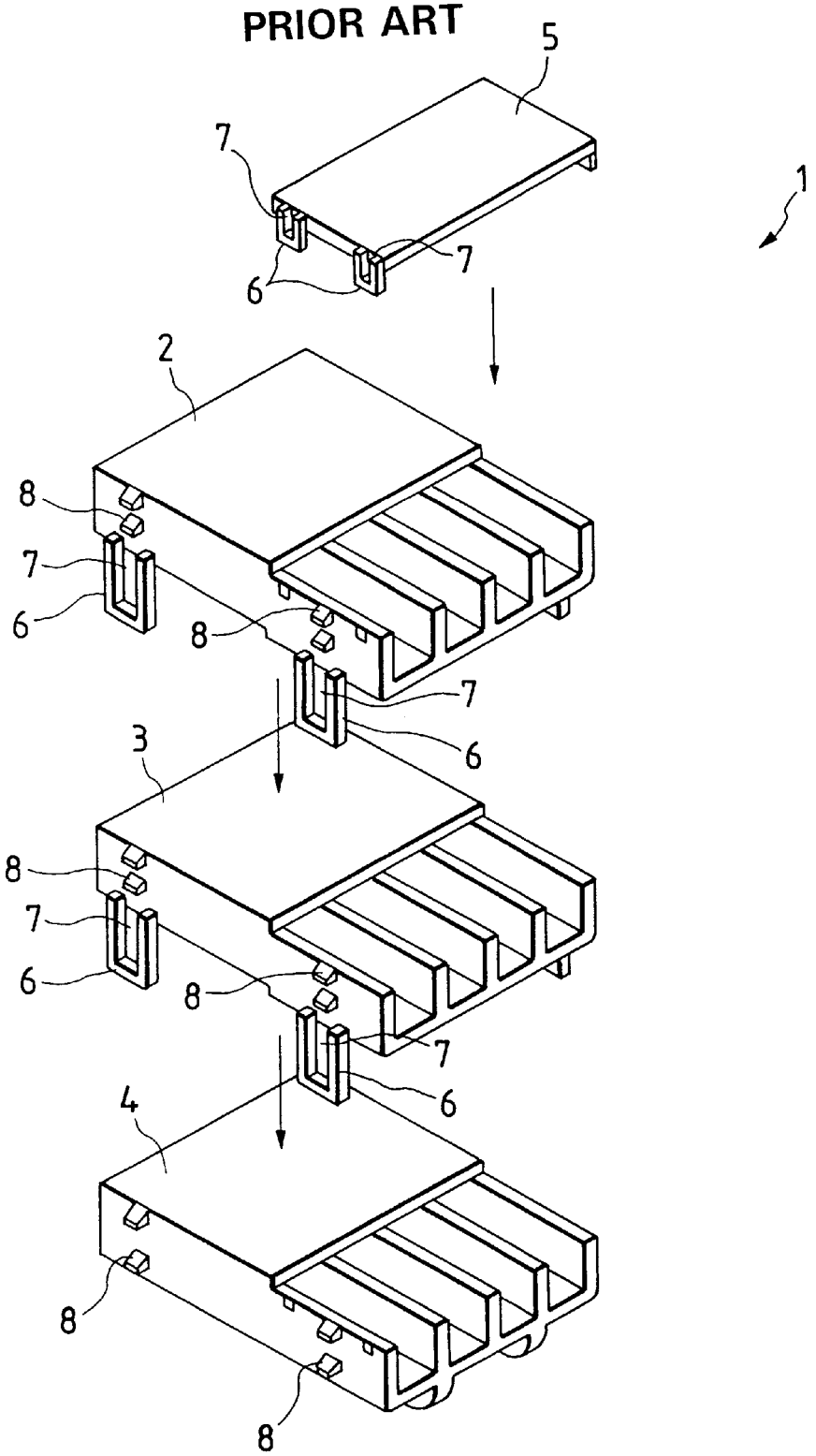
FIG. 5 PRIOR ART
FIG. 5 is an exploded, perspective view of a conventional combination connector.
Figure 6:
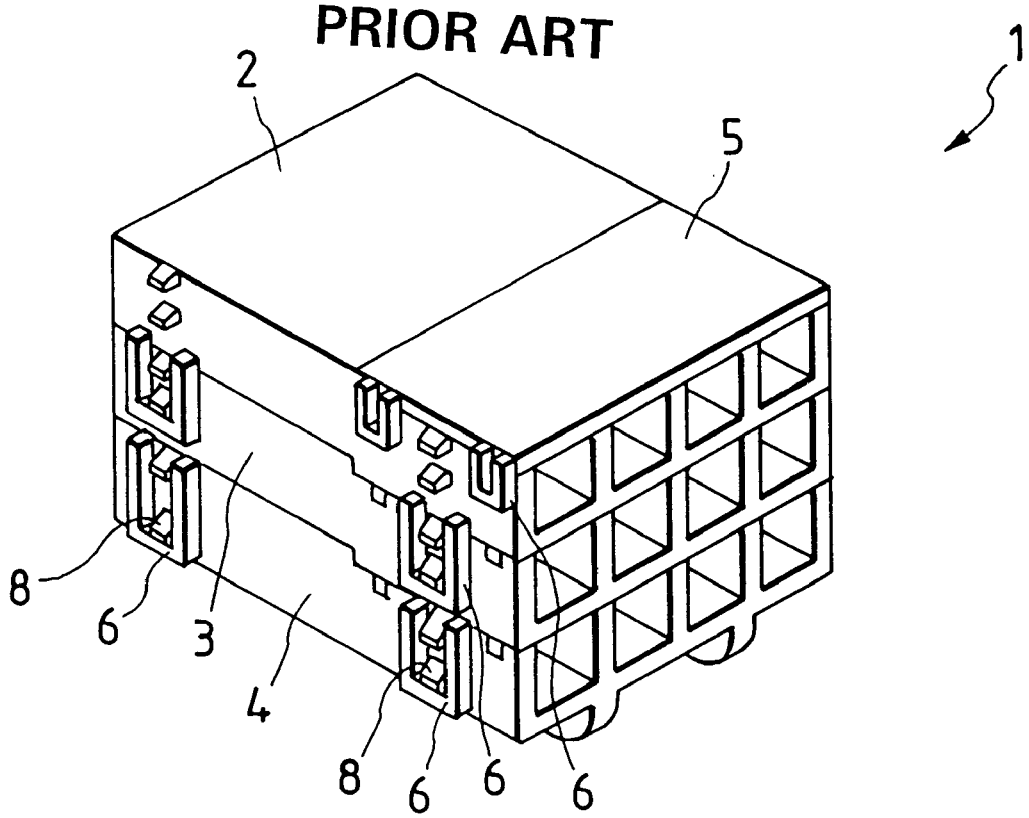
FIG. 6 PRIOR ART
FIG. 6 is a perspective view showing the conventional combination connector in a combined condition.

A preferred embodiment of a combination connector of the present invention will now be described. FIG. 1 shows an upper connector housing 11 and a lower connector housing 12 which jointly constitute the combination connector 10, and FIGS. 2 and 3 show the lower connector housing 12. FIG. 4(*a*) is a perspective view showing a condition in which a lock arm 24 on the lower connector housing 12 is flexed or elastically deformed when a engaging projection 16 on the upper connector housing 11 is to be fitted and engaged in a engaging hole 25 formed through the lock arm 24. FIG. 4(*b*) is a cross-sectional view showing the lock arm 24.

As shown in FIG. 1, a row of terminal receiving chambers 13 for respectively receiving terminals (not shown) are formed in the upper connector housing 11. A lock portion 14 for engagement with a lock portion of a mating connector is formed on the upper side of the upper connector housing. On the lower side of the upper connector housing, there are provided positioning projections 15 for positioning the upper connector housing relative to the lower connector housing 12 when the two connector housings are to be combined together. The engaging projections (engaging portions) 16 are formed respectively on opposite side surfaces of the upper connector housing, and these engaging projections 16 are engaged respectively with the lock arms 24 on the lower connector housing 12 when the two connector housings are combined together. A positioning stopper 28 is provided above each engaging projection 16.

A row of terminal receiving chambers 17 for respectively receiving terminals (not shown) are formed in the lower connector housing 12. A plurality of terminal insertion holes 18 are formed in a rear portion of the upper side of the lower connector housing. Positioning holes 19 for respectively receiving the positioning projections 15 of the upper connector housing 11 are formed in that portion of the upper surface of the lower connector housing disposed above the terminal receiving chambers 17. A cover 20 is integrally connected to the lower side of the lower connector housing 12 through hinges 31 and band portions 32. The band portions 32 are cut, and the cover 20 is turned through the hinges 28 in a direction of arrow a (FIG. 2), and thereby the lower side of the lower connector housing 12 is covered with this cover 20.

The lower connector housing 12 has elastic ribs 23 and 23 formed respectively at opposite side walls thereof and these ribs 23 and 23 are disposed respectively on opposite sides of the row of terminal insertion holes 18. The ribs 23 and 23 can be flexed outwardly in a direction of the width of the lower connector housing, and when the lower connector housing 12 and the upper connector housing 11 are combined together, the ribs 23 and 23 are disposed inwardly of opposite side walls 29 and 29 of the upper connector housing 11. The lock arms 24 are formed in continuous relation to the ribs 23 and 23, respectively. Through the lock arms 24, there are formed engaging holes 25 for respectively engagingly receiving the engaging projections 16 of the upper connector housing 11. A engaging projection 26 is formed below each lock arm 24.

As shown in FIG. 4(*b*), each lock arm 24 is slightly offset outwardly with respect to the corresponding rib 23, and the lock arm 24 and the rib 23 are formed integrally with each other in such a manner that a step portion 27 is formed by them. When the lock arm 24 is flexed outwardly, the rib 23 is also flexed outwardly together with this lock arm 24. As a result, the lock arm 24 can be much flexed outwardly, and a stress, acting on the lock arm 24 at this time, is small.

Elastic lock arms 22 are formed respectively at opposite sides of the cover 20. An engaging hole 21 is formed through each of the lock arms 22. When the cover 20 covers the lower side of the lower connector housing 12, the engaging projections 26 are fitted and engaged in the engaging holes 21, respectively.

The lock arms 22 are formed respectively in continuous relation to ribs 30 formed respectively at the opposite sides of the cover 20. Therefore, when each engaging projection 26 is to be fitted and engaged in the engaging hole 21 in the corresponding lock arm 22, the rib 30 is much flexed outwardly together with the lock arm 22, and the flexing stress, acting on the lock arm 22 at this time, is small.

Next, a procedure of combining the upper and lower connector housings 11 and 12 together will be described.

The upper connector housing 11 is placed on the lower connector housing 12, and the positioning projections 15 are registered with the positioning holes 19, respectively, and in this condition the upper connector housing 11 is pressed against the lower connector housing 12. At this time, the engaging projections 16 of the upper connector housing 11 outwardly flex the lock arms 24 of the lower connector housing 12, respectively, as shown in FIG. 4(*a*). In this manner, each lock arm 24 is much flexed together with the corresponding rib 23, and therefore the amount of flexing of the lock arm 24 itself is small and the stress on the lock arm 24 is small.

When the upper connector housing 11 is further pushed into the lower connector housing 12, the engaging projections 16 are fitted and engaged respectively in the engaging holes 25 formed respectively through the lock arms 24, so that the upper connector housing 11 is combined with the lower connector housing 12.

Then, the band portions 32 are cut, and the cover 20 is turned toward the lower side of the lower connector housing 12, with the hinges 31 bent. Then, the engaging projections 26 are fitted and engaged respectively the engaging holes 21.

In this embodiment, the lock arms 24 are formed respectively in continuous relation to the ribs 23 formed on the lower connector housing 12, and with this construction, when each lock arm 24 is to be engaged with the corresponding engaging projection 16, the lock arm 24 is flexed together with the rib 23, and therefore a combining force for combining the upper and lower connector housings 11 and 12 together is distributed to the lock arm 24 and the rib 23, and the amount of flexing of the lock arm 24 is reduced. As a result, the stress on the lock arm 24 is reduced, and therefore a permanent set of the lock arm 24 is prevented.

In this embodiment, since the ribs 23 and 23 are formed respectively on the opposite side walls of the lower connector housing 12, the strength of the lower connector housing 12 is increased.

In this embodiment, since each lock arm 24 is connected to the corresponding rib 23 through the step portion 27, the strength of the lock arm 24 itself is increased.

Since the ribs 23, formed respectively at the opposite side walls of the lower connector housing 12, are received within the upper connector housing 11, the lock arms 24 will not be accidentally flexed, and therefore the upper and lower connector housings 11 and 12 can be firmly held in the combined condition.

When the lock arms 22, formed on the cover 20, are flexed, the ribs 30 are also flexed outwardly, and therefore the amount of flexing of each lock arm 22 is small, and the stress on the lock arm 22 is small.

While there have been illustrated and described what are considered to be preferred embodiment of the present invention, it will be understood by those skilled in the art that various changes and modifications may be made, and equivalents may be substituted for elements thereof without departing from the true scope of the present invention.

For example, in the above embodiment, the lock arms and the ribs are provided on the lower connector housing, and the engaging portions are provided on the upper connector housing. It cannot be departed from the scope of the present invention if the lock arms and ribs are provided on the upper connector housing, and the engaging portions are provided on the lower connector housing.

Similarly, the positions of the lock arms on the cover and engaging portions in the lower connector housing may be reversed.

As described above, according to the present invention, when the engaging holes on the lock arms are to be engaged respectively with the engaging projections, each of the lock arms is flexed together with the associated rib, and therefore the elasticity of the lock arm will not be lowered, thereby preventing a permanent set of the lock arm. As a result, the lock arm can be firmly retained relative to the engaging portion, and the plurality of connector housings can be firmly combined together.

According to the present invention, when the lower side of the lowermost connector housing is to be covered with the cover, the lock arms are brought into engagement with the engaging portions, respectively, so that each lock arm is flexed together with the associated rib, and therefore the flexing stress on the lock arm is reduced, and a permanent set of the lock arm is prevented.

According to the present invention, the lock arms are engaged respectively with the engaging portions at the opposite side portions of the connector housing, and therefore the connector housings of the combination connector can be firmly combined together.

What is claimed is:

1. A combination connector comprising:

a plurality of connector housings which are stacked together in a multi-stage manner;

an elastic lock arm provided on one of an upper connector housing and a lower housing of any two adjacent connector housings in the plurality of connector housings;

an elastic rib formed on the one connector housing, and having an extended portion which is connected to the one connector housing and is flexible with respect to said one connector housing, the lock arm is integrally formed with the extended portion and also extending in a direction identical with the extending direction of the extended portion; and an engaging portion provided on the other connector housing of the two adjacent connector for engaging with the lock arm, wherein the lock arm is flexed together with the associated extended portion of the rib when the lock arm is to be engaged with the engaging portion.

2. The combination connector as set forth in claim 1, wherein the lowermost connector housing in the plurality of connector housings further includes:

a cover for covering a lower side of the lowermost connector housing;

an elastic lock arm provided on one of the cover and side wall of the lowermost connector housing;

an elastic rib formed on the lowermost connector housing and having an extended portion which is connected to the lowermost connector housing and is flexible with respect to the lowermost connector housing, the lock arm is integrally formed with the extended portion and also extending in a direction identical with the extending direction of the extended portion; and an engaging portion provided on the other of the cover and the side wall of the lowermost connector housing for engaging with the lock arm, and wherein the lock arm is flexed together with the associated extended portion rib when the lock arm is to be engaged with the engaging portion.

3. The combination connector as set forth in claim 1, wherein a engaging hole is formed in the lock arm provided on the one of the upper connector housing and the lower connector housing in the two adjacent connector housings, and the engaging portion provided on the other of the two connector housings is in the form of a projection which is fitted and engaged in the associated engaging hole.

4. The combination connector as set forth in claims 1, wherein the lock arm and the rib provided on the one of the upper connector housing and the lower connector housing in the two adjacent connector housings is respectively a pair of lock arm members and a pair of rib members, and the engaging portion provided on the other of the two adjacent connector housings is a pair of engaging portions, and wherein the pair of lock arm members and ribs are formed respectively on opposite side walls of the one of the two adjacent connector housings, and the pair of engaging portions are formed respectively on the opposite side walls of the other connector housing of the two adjacent connector housings.

5. The combination connector as set forth in claim 2, wherein a engaging hole is formed in the lock arm provided on the upper connector housing and the lower connector housing in the one of the two adjacent connector housings, and the engaging portion provided on the other of the two connector housings is in the form of a projection which is fitted and engaged in the associated engaging hole.

6. The combination connector as set forth in claims 2, wherein the lock arm and the rib provided on the one of the upper connector housing and the lower connector housing in the two adjacent connector housings is respectively a pair of lock arm members and a pair of rib members, and the engaging portion provided on the other of the two adjacent connector housings is a pair of engaging portions, and wherein the pair of lock arm members and ribs are formed respectively on opposite side walls of the one of the two adjacent connector housings, and the pair of engaging portions are formed respectively on the opposite side walls of the other connector housing of the two adjacent connector housings.

7. The combination connector as set forth in claim 2, wherein a engaging hole is formed in the lock arm provided on the one of the cover and the side wall of the lowermost connector housing, and the engaging portion provided on the other of the cover and the side wall of the lowermost connector housing is in the form of a projection which is fitted and engaged in the associated engaging hole.

8. The combination connector as set forth in claims 2, wherein the lock arm and the rib provided on the one of the cover and the side wall of the lowermost connector housing is respectively a pair of lock arm members and a pair of rib members, and the engaging portion provided on the other of the cover and the side wall of the lowermost connector housing is a pair of engaging portions, and wherein the pair of lock arm members and ribs are formed respectively on opposite side walls of the one of the two adjacent connector housings, and the pair of engaging portions are formed respectively on the opposite side walls of the other connector housing of the two adjacent connector housings.

9. The combination connector as set forth in claims 3, wherein the lock arm and the rib provided on the one of the upper connector housing and the lower connector housing in the two adjacent connector housings is respectively a pair of lock arm members and a pair of rib members, and the engaging portion provided on the other of the two adjacent connector housings is a pair of engaging portions, and wherein the pair of lock arm members and ribs are formed respectively on opposite side walls of the one of the two adjacent connector housings, and the pair of engaging portions are formed respectively on the opposite side walls of the other connector housing of the two adjacent connector housings.

* * * * *